US005226607A

United States Patent [19]

Karg

[11] Patent Number: 5,226,607

[45] Date of Patent: Jul. 13, 1993

[54] CHOPPER

[75] Inventor: Erwin Karg, Neusäss, Fed. Rep. of Germany

[73] Assignee: Lescha Maschinenfabrik GmbH & Co. KG, Fed. Rep. of Germany

[21] Appl. No.: 725,831

[22] Filed: Jul. 3, 1991

[30] Foreign Application Priority Data

Jul. 28, 1990 [DE] Fed. Rep. of Germany ..... 4024060

[51] Int. Cl.[5] ..... B02C 18/22

[52] U.S. Cl. ..... 241/166; 241/243

[58] Field of Search ..... 241/166, 167, 242, 243

[56] References Cited

U.S. PATENT DOCUMENTS

| | | | |
|---|---|---|---|
| 524,274 | 8/1894 | Edwards | 241/242 |
| 1,423,867 | 7/1922 | Mitts et al. | 241/167 |
| 1,976,751 | 10/1934 | Short | 241/167 X |
| 2,841,341 | 7/1958 | Noble et al. | 241/243 |
| 4,106,708 | 8/1978 | Kropa | 241/242 X |
| 4,489,896 | 12/1984 | Cerroni | 241/243 X |

FOREIGN PATENT DOCUMENTS

| | | |
|---|---|---|
| 0024993 | 5/1983 | European Pat. Off. . |
| 3324274 | 5/1987 | Fed. Rep. of Germany . |

*Primary Examiner*—Mark Rosenbaum
*Assistant Examiner*—Frances Chin
*Attorney, Agent, or Firm*—Harrison & Egbert

[57] ABSTRACT

In order in the case of a chopper for waste material and more particularly for garden waste, comprising a feed hopper and a roller-like cutting rotor arranged at a lower end of the hopper and adapted to be driven for cooperation with a stationary mating knife arrangement, to achieve quiet operation in a manner which makes the chopper easy to use and provides for a long working life, the roller-like cutting rotor is constituted by a roller-like cutting rotor whose axis extends transversely in relation to the axis of the hopper, and which bears circumferential teeth between which gaps are provided, which during operation are cleared by a clearing spud adapted to plunge into them.

13 Claims, 4 Drawing Sheets

CHOPPER

BACKGROUND OF THE INVENTION

The invention relates to a chopper for waste material and more particularly for garden waste, comprising a feed hopper and a cutting member arranged at a lower end of the hopper and adapted to be driven for cooperation with a stationary mating knife arrangement.

A chopper of this type has been described in the German patent 3,324,274. In the case of this known arrangement the cutting member is constituted by a knife disk, which is directly mounted on the output shaft of a drive motor and accordingly rotates a very high speed of normally 2,800 rpm. Arrangements of this type have been seen from experience to produce a high noise level. This is due on the one hand to the high speed of rotation of the knife disk. However on the other hand a substantial part of the noise is produced owing to the fact that the material to be chopped is slung against the walls of the hopper. A further particularly significant disadvantage of these arrangements is due to the fact that in this case choppings with a comparatively smooth or intact surface are produced so that there is a comparatively poor mechanical breaking down of the material to be chopped in the sense that organisms causing rotting are not readily able to act on the material. A further point is that known arrangements also necessitate extensive safety precautions to prevent accidents. This applies both for a possible detachment or fracture of the knife disk as well as for the possibility of material being knocked or slung out of the device.

SHORT SUMMARY OF THE PRESENT INVENTION

Accordingly one object of the invention is to provide a chopper of the type initially mentioned that is not only quiet in operation but furthermore comminutes the material in such a manner that rotting or decay thereof is promoted.

A still further object of the invention is to simultaneously ensure a high degree of safety and ease of use.

Yet another aim of the invention is to provide for trouble-free operation and a long working life.

In order to achieve these and/or other objects appearing from the present specification, claims and drawings the cutting member is constituted by a roller-like cutting rotor whose axis extends transversely in relation to the axis of the hopper, and which bears circumferential teeth between which gaps are provided, which during operation are cleared by a clearing spud adapted to plunge into them.

These features make it possible to completely overcome the disadvantages of the devices of the type initially mentioned so far produced. The use of a roller-like cutting rotor entails the advantage of being able to design the chopper to run at a low speed of rotation, this leading to the advantage of a reduction in the quantity of noise produced and making the device safer to use. A further advantage of the roller-like cutting rotor is to be seen in the fact that it automatically draws in the material it contacts and prior to the actual cutting action subjects the material to a crushing or disintegrating effect against the stationary mating knife arrangement. This entails not only ease of operation without the danger of material being knocked or flung back but also leads to a particularly desirable effective mechanical breaking up of the material to be chopped so that the microorganisms causing decay are able to act on the material, this being something that leads to an advantageous acceleration of the decay process. Simultaneously owing to the pressing or crushing action of the roller-like cutting rotor there is also a holding down or steadying effect, that is to say the material to be cut is pressed in the part above the stationary mating knife against the wall of the feed hopper so that beating noise in the hopper is prevented. The clearing spud entails the advantage of ensuring that the roller-like cutting rotor is not able to become clogged and accordingly the advantageous effects noted above are always produced. Furthermore a certain subsequent cutting effect may be produced by the clearing spud. The features in accordance with the invention consequently entail a high degree of reliability of the device.

Advantageous developments and convenient forms of the invention are recited in the claims. Thus for instance the clearing spud may be arranged to be driven in step with the gaps between the teeth by means of a disk cam which is driven with the roller-like cutting rotor and is preferably arranged coaxially thereto. In this respect the disk cam may simply be adapted for cooperation with a cam follower, which is preferably under the action of a loading spring and is provided with a roller in the form of an anti-friction bearing. These features lead to a reliable mechanical operation of the clearing spud, something than ensures a sturdy and reliable design even under rough working conditions.

In accordance with a further advantageous feature the clearing spud is arranged so as to plunge into the gaps between the teeth adjacent to the ascending half of the roller-like cutting rotor and the mating knife arrangement is adjacent to the descending half of the roller-like cutting rotor. These features ensure not only smooth intake of the material to be chopped but also the advantage that ejection of the chopped material takes place dependable so that the same falls freely downwards and a blower is unnecessary. Furthermore it is possible for the reciprocating clearing spud which plunges down into the gaps between the teeth, to act as a wall part which moves upwards and downwards and is adjacent to the lower end of the feed hopper, such wall part having a self-cleaning effect owing to its movement. There is therefore no chance of material accumulating on the clearing spud.

As a further feature of the invention it is possible for the mating knife arrangement to have at least one main stationary main knife, which is preferably constituted by an adjustable knife bar, which extends downwards from the periphery of the roller-like cutting rotor, and whose cutting edge is preferably lower down than the axis of the roller-like cutting rotor, and at least one subsequent cutting device, which comes after the main knife, is preferably separate therefrom and has at least one cutting edge, the same being preceded by a groove or channel and being followed by a paring surface. Even in the case of particularly tough and fibrous material these features entail a reliable chopping action. Material which has not so far been cut against the main knife, will be reliably cut or will be pared down on the cutting edge of the subsequent cutting device. Therefore it is possible for the clearing spud, against which a further subsequent cutting effect is possible, to be relieved.

As yet another feature of the invention it is possible for the roller-like cutting rotor to be constituted by a plurality of disks arranged side by side and which are mounted in such a manner as to prevent relative twist on a driven shaft. These features are responsible for a reduction in the costs and simplification in the stock-holding of spare parts and may render it cheaper to maintain the rolls.

Yet another feature of the invention is such that the cutting teeth, which are preferably in the form of asymmetrical saw teeth in cross section, of the roller-like cutting rotor are made without any rake angle and preferably with a clearance angle of 30° and leading edge angle of 60°. These features lead to a reliable draw in and reliable pressing of the material and there is the advantage that there is no excessively rapid cut. Furthermore there is here the advantage that owing to absence of undercut at the back of the cutting teeth the spud is able to ensure a particularly effective clearing effect. Furthermore such teeth are particularly strong and robust.

Further advantageous developments and convenient features of the invention will be gathered from the claims and from the following more detailed account of working embodiments illustrated in accompanying figures.

LIST OF THE SEVERAL FIGURES OF THE DRAWINGS

DETAILED ACCOUNT OF WORKING EMBODIMENTS OF THE INVENTION.

Figure 1:
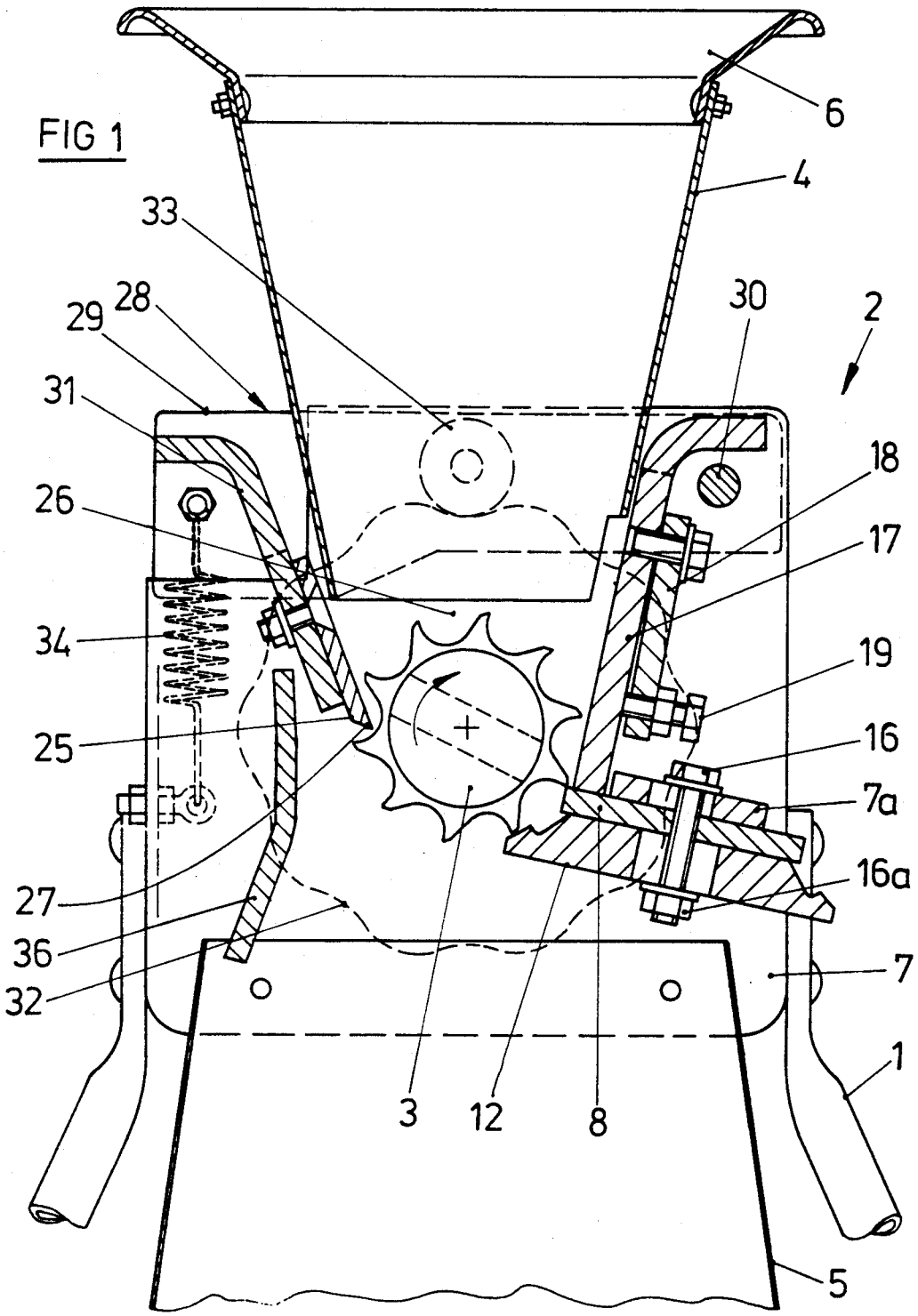
FIG. 1 shows a vertical section taken through a garden waste chopper in accordance with the invention radially to the roller-like cutting rotor.
Figure 2:
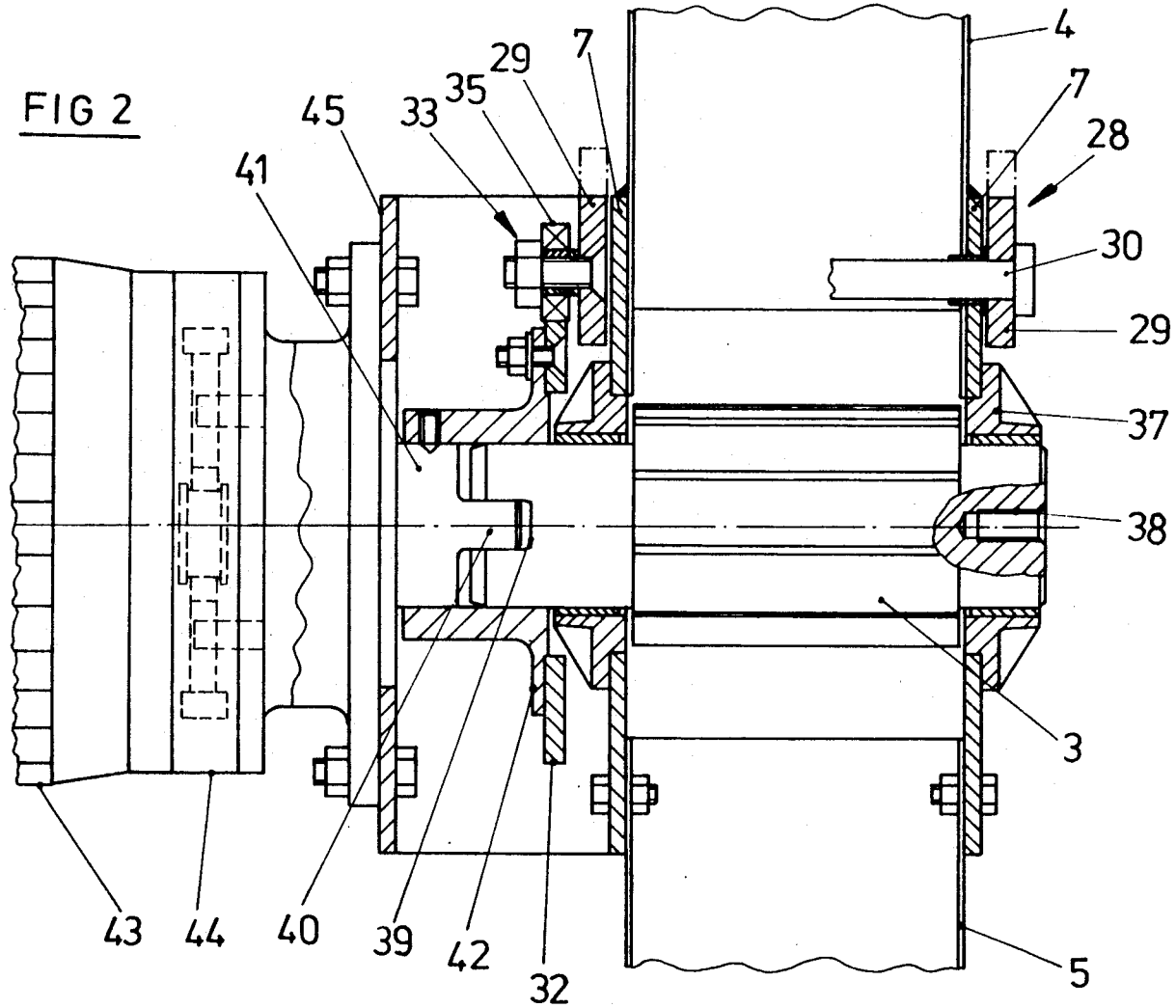
FIG. 2 is a vertical section taken parallel adjacent to axis of the roller-like cutting rotor as in the arrangement in accordance with FIG. 1.

The garden waste chopper illustrated in FIGS. 1 and 2 consists, as may be best seen from FIG. 1, of a chopper unit 2 arranged upright on legs 1 and having a roller-like cutting rotor 3 which rotates at a slow speed, in the present case of 50 rpm, about its horizontal axis. Above the roller-like cutting rotor 3 there is a feed hopper 4 with a vertical axis and underneath the roll there is an ejection chute 5 arranged with a vertical axis. At the top end of the feed hopper 4 it is possible to have an intake funnel 6. In order to mount the said elements the chopper device 2 possesses two lateral parallel bearing support units 7, on which the cutting rotor 3 is bearinged and on which the feed hopper 4 and the ejection chute 5 are rested and attached with side walls parallel to the bearing support units, as best shown in FIG. 2.

Figure 3:
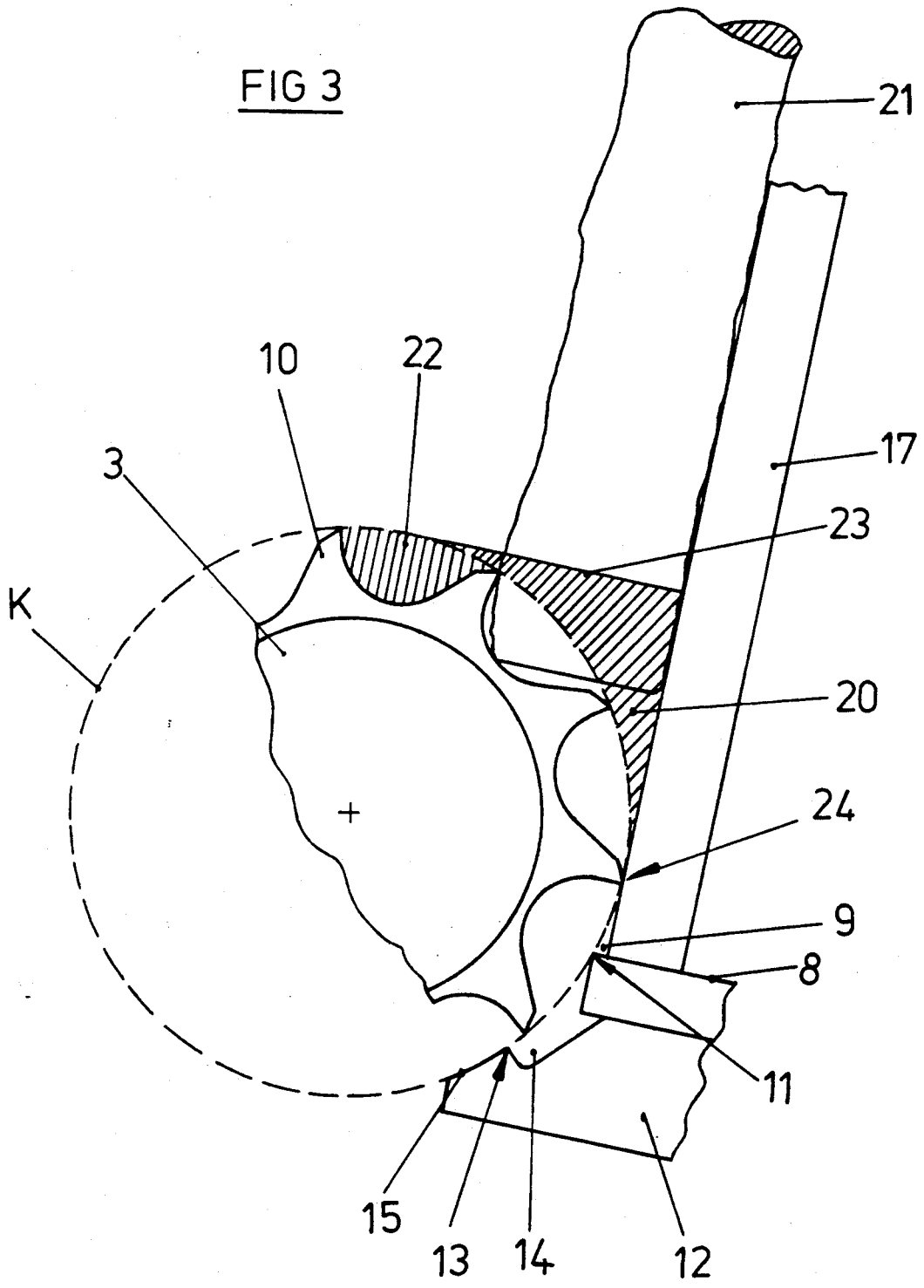
FIG. 3 shows on a larger scale the draw-in and cutting part of the roller-like cutting rotor in a manner corresponding to FIG. 1.

The cutting rotor 3 which extends for the full clearance distance between the bearing support units, cooperates at its downwardly moving circumferential part with a stationary mating knife arrangement which is arranged underneath the axis of the cutting rotor. This mating knife arrangement comprises, as best shown in FIG. 1, a main knife 8 in the form of a steel bar sloping downwards from the periphery of the cutting rotor 3, the cutting edge of the bar being not higher the level as the axis of the cutting rotor and in the present case lower than this axis and it projects past an adjacent transverse wall, which constitutes a bridge between the bearing support units so that, as best shown in FIG. 3, there is a pocket-like narrowing gap 9 in front of the cutting edge of the main knife 8. The steel bar constituting the main knife 8 is able to be so adjusted in relation to the cutting rotor 3 that its teeth 10 move past the stationary knife edge 11 without any chance of fouling them. The stationary mating knife arrangement comprises furthermore, as shown in FIGS. 1 and 3, a subsequent cutting device. The latter consists of an aluminum molding 12 with a cutting edge 13 which is preceded by a channel 14 and is followed by a paring surface 15. It is possible for the cutting rotor 3 to run into the aluminum molding 12. Therefore it is necessary to only have a rough adjustment of the aluminum molding 12. In order to receive the mating knife arrangement there is a crosspiece *7a* which spans the two bearing support units 7 and is connected with them; it is provided with holding screws 16 running through slots in it. The holding screws 16 are able to be screwed into suitable threaded holes in the main knife 8 resting on the crosspiece *7a* so that their ends projecting from the main knife 8 extend through slots in the aluminum molding 12, which abuts the main knife, the molding being secured by lock nuts. By tightening the screws 16 the main knife 8 is clamped in place. By tightening the nuts 16*a* the aluminum molding 12 constituting the subsequent cutting device is clamped in place. The knife bar constituting the main knife 8 and the molding 12 constituting the subsequent cutting device are in the present case designed as reversible tools which are symmetrical about their median longitudinal plane, this being an advantage as regards maintenance work on the device.

Over the mating knife arrangement to the invention provides a pressing plate 17, which constitutes a feed table associated with the mating knife arrangement. The pressing plate 17 is adjustably mounted on a crosspiece 18 spanning the two bearing support units 7, the possibility of such adjustment being indicated by setting screws 19. The pressing plate 17 is so set that, as best shown in FIG. 3, it is tangent to the outside circle K of the cutting rotor 8 without fouling the same. In this case the pressing plate 17 is arranged to slope away from the periphery of the cutting rotor in order to create a funnel effect so that the point of tangency to the outside circle K is lower down than the level of the axis of the cutting rotor 3. The pressing plate 17 extends, as best shown in FIG. 3 as well, downwards past the point of contact so that there may be a projection of the cutting edge 11, which is also tangent to the outside circle K, of the main knife 8 past the pressing plate 17 and therefore of the pocket-like narrowing gap 9 in front of the cutting edge 11.

In the narrowing gap 20, which is on the intake side of the point of contact between the pressing plate 17 and the outside circle K material to be chopped, indicated in the form of a branch 21, is drawn in and at this point such material is pressed and squeezed. The draw in of the material is in this case effected by the teeth 10 of the cutting rotor 3, which move upwards on the intake side and bite into the material. The teeth 10 of the cutting rotor 3 in this case posses a comparatively large leading edge angle of 60° and a clearance angle of 30°. There is no rake angle. Therefore on the one hand it is possible to have a comparatively large thickness of the heads of the teeth 10 of, in the present case, 5 mm and thus a high degree of strength of the teeth and on the other hand it is possible to avoid an excessively fast cutting action. The teeth 10 without any rake in fact cut comparatively slowly into the material which is to be drawn in. The material is hence reliably drawn in but it is not cut off excessively rapidly.

The material pulled in by the teeth 10 arranged right along the roll over the pressing plate 17 functioning as a feed table is initially squeezed as it is drawn in and thereby pressed into the gaps 22 between the teeth 10, there naturally being a lateral spread of the material within gaps 22 arranged over the length of the roll. Owing to this squeezing and pressing operation the material to be processed is subjected to a satisfactory mechanical disintegrating action even at this stage so that later attack by microbes is favored. In order to effect a reliable and sufficiently rapid processing of the material, in the present case, as best shown in FIG. 3 by different shading, the cross section of the tooth gaps 22 is 50% of the cross section of the narrowing gap 20 functioning as a squeeze triangle or squeezing jaw opening between the outside circle K, the pressing plate 17 tangent to the same and a tangent, which is perpendicular thereto, at the outside circle K. The length of the upper limit 23 constituted between the said tangent of the triangular jaw opening is equal to half the outside circle of the cutting rotor 3. The optimum size for the maximum thickness of branch able to be processed is, as illustrated in FIGS. 3 at 21, somewhat less than this. This size is in the present case equal to 30/10 to 4/10 of the outside circle K of the cutting rotor 3.

Owing to the pressing and squeezing operation taking place in the narrowing gap 20 the material to be processed is always disintegrated and consequently mechanically opened up so as to encourage the action of organisms causing decay and later rotting down. Simultaneously owing to the fact that the material to be processed is reliably placed on the pressing plate 17 and is pressed against same, there is also an extremely valuable holding down effect which not only cuts down noise but also facilitates later cutting adjacent to the mating knife arrangement. This cutting action is still further facilitated since material forced between the teeth in the narrowing gap 20 will, after passing through the narrowest part of the gap 20 indicated at 24, be able to expand into the pocket-like gap 9 preceding the cutting edge 11 of the main knife 8. The previously pressed material then takes up a position in the narrowing gap 9 and is accordingly reliably pressed at the cutting edge 11. This operation is repeated in the subsequent cutting device. The material coming from the cutting edge 11 of the main knife may expand again into the pocket constituted by the channel 14 and be turned over, this promoting reliable cutting at the cutting edge 13 of the subsequent cutting device. Particularly tough and fibrous material, which has still not been cut, may then be shaved or pared down on the paring surface 15.

The material contained in the gaps 22 between the teeth may drop out downwards after the gaps 22 have moved past the paring surface 15. Material which does not fall down of its own accord is, as indicated in FIG. 1, cleared out of the way adjacent to the upwardly moving half of the periphery of the cutting rotor 3 by means of a clearing spud 25 which is diametrally opposite to the mating knife arrangement and extending right along the cutting rotor 3. The clearing spud 25 accordingly ensures that the tooth gaps 22 are reliably cleared as they move downwards into the working space 26, whose bottom is delimited by the cutting rotor 3 and accordingly they are able to be occupied by new material. The clearing spud 25 may be designed in the form of a slide caused to reciprocate by means of a drive synchronously with the movement of the gaps 22. In the illustrated working embodiment the clearing spud 25, which is constituted by a blade provided with a sharp clearing edge 27, is secured to a U-like pivot frame 28 whose lateral limbs 29, as best shown in FIG. 2, flank the lateral bearing support unit 7 and at their free end are bearinged by means of a shaft 30, which in the present case is continuous, on the bearing support units 7. The opposite end of the limbs 29 is spanned by a rib 31, on which the blade, which constitutes the clearing spud 25, is replaceably attached by screws. The bearing support units 7 are provided with marginal recesses adjacent to the rib 31, something that makes it possible to arrange the frame 28 without needing so much space.

The pivot arm 28 is able to be so actuated by means of a disk cam 32, which is able to be driven by the cutting rotor 3 and is coaxial thereto, that the clearing spud 25 plunges into the gaps 22 between the teeth as they move past and it allows the teeth to pass without collision. In the illustrated working embodiment the clearing spud 25 plunges in the opposite direction to the movement of the cutting rotor 3, that is to say downwards, into the gaps 22 between the teeth, and in the same direction as the cutting rotor 3 that is to say upwards, moves out of the tooth gaps again. The disk cam 32 is accordingly provided with recesses corresponding to the gaps between the teeth and with humps corresponding to the teeth 10 themselves. The height of these humps is so sized that the teeth 10 move past the tip 27 of the clearing spud 25 without colliding with it but also without an substantial clearance. This leads to a further subsequent cutting effect. The disk cam 22 is engaged by a follower 33 connected with the frame 28. In this respect it may be a question of a pin projecting laterally from the limb 29, which is loaded by means of spring 34 against the circumferential surface of the cam disk 32. The spring 34, as shown in FIG. 1 also, is on the one hand in engagement with the frame 28 and on the other hand with the frame of the chopper device 2, that is to say on one of the bearing support units 7. In order to reduce wear and noise during operation it is possible for the follower 33, as best shown in FIG. 2 as well, to be provided with a roller constituted by an anti-friction bearing 35. The disk cam 32 may be mounted on a lateral journal of the cutting rotor 3.

The feed hopper 4 ends in the present case short of the cutting rotor 3 underneath it. This clearance between the roll and the hopper is spanned on the one hand in the part between the bearing support units 7 by the pressing plate 17 and on the other hand by the clearing spud 25. The clearing spud 25 constitutes in this case a wall part which vertically reciprocates and which owing to this movement is continuously cleaned. The pressing plate 17 and the clearing spud 25 are so set at a slope away from the periphery of the cutting rotor 3 that the working space 26 delimited thereby widens upwardly. The same applies for the transverse walls, which are practically extended by the pressing plate 17 and by the clearing spud 25, of the feed hopper 4. Underneath the clearing spud 25 an ejection baffle 36 is provided which is opposite to the subsequent cutting device and which simultaneously may function as the rib connecting the bearing support units to each other. It is by means of the ejection baffle that the material pushed over the paring surface 15 is reliably guided into the ejection chute 5.

The cutting rotor 3 is, as best shown in FIG. 2, supported on the bearing support units 7 with the aid of flange bearings 37. Therefore it is possible for the bearing support units 7 to be provided with internal diameters at least equal to the diameter of the cutting rotor 3 so that the latter may be inserted therethrough. In order to be able to pull off the cutting rotor 3, the same is provided with a thread 38 on the draw off end opposite to the drive end so that a draw rod may be inserted into the thread. On the drive end the cutting rotor 3 is able to be coupled by a dog clutch, constituted by a groove 39 and a spline 40, with the output of a drive device in the form of a stub shaft 41. A hub 42 is mounted on the latter to bear the disk cam 32. The dog clutch renders possible simple removal of the cutting rotor 3 from the side.

The drive device comprises a drive motor 43 with a step-down transmission 44 on the output side. In the illustrated working embodiment this transmission 44 is in the form of a planocentric drive, which is particularly slim and makes possible a very high reduction ratio. The stub shaft 41 practically constitutes the output of the step-down transmission 44. The drive motor 43 and the step-down transmission 44 are joined together as a single unit, which is flange mounted on a support plate 45 on the frame and which together with the adjacent bearing support unit defines a chamber for receiving the disk cam 32 mounted in the present case on the drive end of the cutting rotor 3. The support plate 45 and the adjacent bearing support unit 7 spaced from it may be in the form of side limbs of a U-like pressing.

Figure 4:
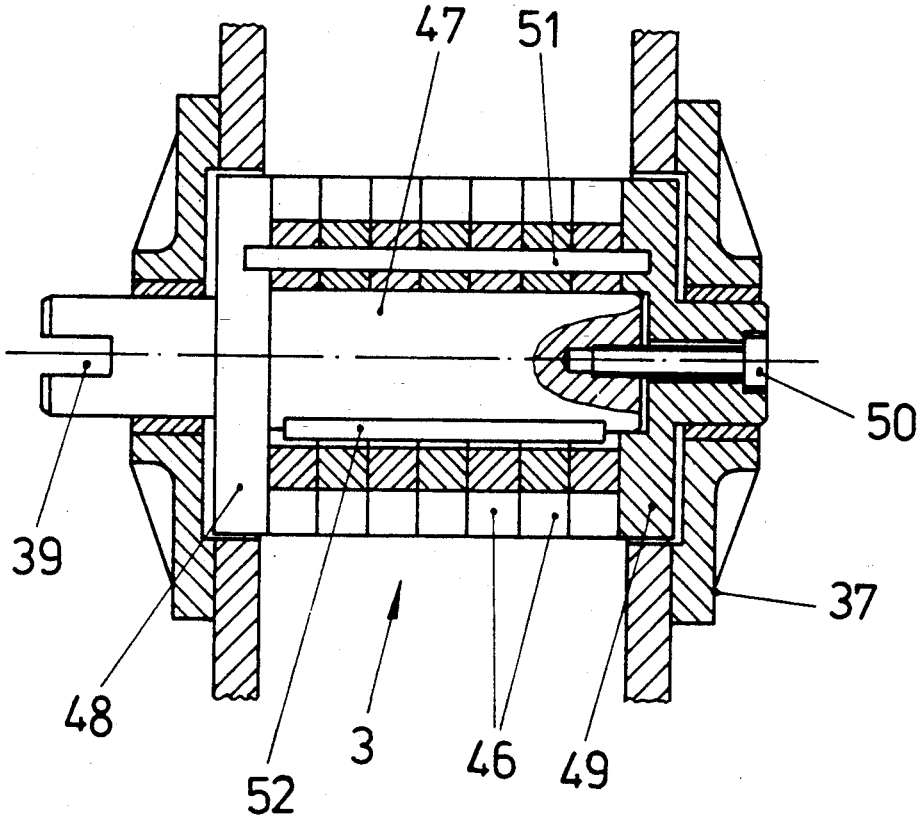
FIG. 4 shows a section taken through a roller-like cutting rotor made up of a plurality of parts which are joined together.

In the illustrated working embodiment of FIGS. 1 and 2 the cutting rotor 3 is in the form of a single-piece component. However it would also be possible for the cutting rotor 3 to be made up of a plurality of parts for reducing the amount of spare part to be stocked and to simplify repairs. One design of this type is illustrated in FIG. 4. In this case the cutting rotor 3 consists of a plurality of identical disks 46 arranged so that their teeth and tooth gaps are in alignment with each other and they are mounted on a shaft 47. In this respect it is possible for the shaft 47 to be permanently flange mounted on an associated drive stub. In the illustrated working embodiment there is as above an insertion coupling as for instance as indicated by the groove 39 adjacent to the journal of the shaft 47 on the drive end. The disks 46 are clamped on the shaft 47. The latter is for this purpose designed at the drive end with a fixed abutment 48 in the form of a circumferentially extending collar. Opposite to this there is a movable abutment 49 in the form of a flange ring molded on a hub adapted to be slipped onto the shaft 47. The hub which bears the flange ring 49 and is centered on the shaft 47 is able to be drawn on by means of tightening screw 50 so that the disks 46 are clamped in place. In order to have tooth gaps aligned right along the roll, this making the clearing spud arrangement simpler, a positive or interlocking engagement of the disks 46 is provided for. For this purpose, as illustrated in the top part of FIG. 4, it is possible to have a rod 51 inserted through an eccentric hole and whose ends are fixed on the abutment side or, as illustrated in the bottom part of FIG. 4, it is possible to simply have a key 52 extending into groove in the shaft and in the disks. By means of such an arrangement there is also a positive entrainment of the knife roll 3 in the drive direction.

I claim:

1. A device for chopping garden wastes comprising:

a roller-like cutting rotor which is rotatably connected to a driving device, said rotor having cutting teeth extending therearound, said rotor having tooth gaps between said cutting teeth;

a feed hopper for receiving the garden wastes, said cutting rotor positioned at a lower end of said feed hopper, said cutting rotor having an axis of rotation extending transverse to a longitudinal axis of said feed hopper;

a stationary mating knife means positioned so as to be interactive with said cutting rotor for the chopping of garden wastes; and a clearing spud extending adjacent said cutting rotor in a position opposite said mating knife arrangement, said clearing spud actuated by a disk cam driven with said cutting rotor, said clearing spud having a contact tip, said disk cam for actuating said clearing spud such that said contact tip enters and exits said tooth gaps, said contact tip passing without contact with said cutting teeth.

2. The device as claimed in claim 1 wherein the clearing spud is adapted to plunge into the tooth gaps in a direction opposite to a direction of the rotation of the roller-like cutting rotor and to leave such gaps in the same direction as the rotation of the roller-like cutting rotor.

3. The device as claimed in claim 1 said disk cam arranged coaxially to the cutting rotor, said disk cam is in cooperation with a follower, said follower is urged by a spring against said disk cam, said disk cam is connected with the clearing spud so that the spud moves in step with the rotation of the tooth gaps.

4. The device as claimed in claim 3 wherein the clearing spud is mounted on a cross part of a pivot U-like member, said U-like member bears the follower, said follower is in engagement with the disk cam arranged coaxially to the roller-like cutting rotor.

5. The device as claimed in claim 4 wherein the clearing spud is arranged to plunge downwards into the tooth gaps adjacent to the upwardly moving half of the roller-like cutting rotor and the mating knife arrangement is arranged adjacent to the descending half of the roller-like cutting rotor.

6. The device as claimed in claim 1 wherein the roller-like cutting rotor is bearinged with flange bearings on two lateral parallel bearing support units which are spanned by an ejection baffle, said baffle is arranged opposite to the mating knife arrangement, the feed hopper and an ejection chute are attached to said bearinged support units, the distance between the feed hopper and the roller-like cutting rotor being spanned by the clearing spud, said clearing spud is set at a slope extending away from the roller-like cutting rotor in the same direction as the adjacent transverse wall of the feed hopper and by a pressing plate which is arranged adjustably and is set at a slope away from the roller-like cutting rotor in the same direction as the adjacent transverse wall of the feed hopper, said pressing plate being arranged in front of the mating knife arrangement.

7. The device as claimed in claim 1 wherein the mating knife arrangement comprises at least one stationary main knife, which includes a knife bar which extends down at a slope from a periphery of the roller-like cutting rotor and is adjustable with respect thereto, a cutting edge of the main knife being arranged below the axis of the roller-like cutting rotor.

8. The device as claimed in claim 7 wherein the mating knife arrangement has at least one subsequent cutting device arranged following and separate from the main knife, said subsequent cutting device is preceded by a channel and is followed by a paring surface partly extending underneath the roller-like cutting rotor.

9. The device as claimed in claim 1 wherein the roller-like cutting rotor comprises a plurality of adjacently placed disks with the tooth gaps in alignment, said disks being mounted on a driven shaft, in such a manner as to prevent relative twist.

10. The device as claimed in claim 1 wherein the roller-like cutting rotor is mounted by flange bearings on bearing support units provided with an internal diameter at least equal to the diameter of the roller-like cutting rotor, said cutting rotor is driven at a speed of 50 rpm, said cutting rotor having a drive journal which is able to be coupled by means of an insertion coupling with an output, said cutting rotor connected to a step-down transmission being flange mounted on a support plate parallel to the bearing support units.

11. The device as claimed in claim 1 wherein the cutting teeth have the form of asymmetrical saw teeth having a relief angle of 30° and a leading edge angle of 60°, said saw teeth having no rake.

12. The device as claimed in claim 1, wherein the tooth gaps on the roller-like cutting rotor have a cross section which is equal to approximately half of the cross section of a squeezing space of triangular form defined between the outside circle of the roller-like cutting rotor, a wall tangent thereto and a tangent perpendicular thereto at an outside circle of the roller-like cutting rotor.

13. The device of claim 1, said disk cam having recesses corresponding to said tooth gaps, said disk cam having humps corresponding to said cutting teeth, said contact tip entering and exiting said tooth gaps relative to a movement of said clearing spud with respect to said humps and recesses.

* * * * *